US006119815A

United States Patent [19]

Ziegler

[11] Patent Number: 6,119,815

[45] **Date of Patent: *Sep. 19, 2000**

[54] SAFETY SKIRT

[76] Inventor: Kimberly Ziegler, P.O. Box 244, Eden, N.Y. 14057-0244

[ * ] Notice: This patent issued on a continued prosecution application filed under 37 CFR 1.53(d), and is subject to the twenty year patent term provisions of 35 U.S.C. 154(a)(2).

[21] Appl. No.: 09/027,162

[22] Filed: Feb. 20, 1998

[51] Int. Cl.[7] ..... B66B 9/02

[52] U.S. Cl. ..... 187/269; 254/122

[58] Field of Search ..... 187/269, 240, 187/244, 414, 211; 254/122, 93 HP, 93 R

[56] References Cited

U.S. PATENT DOCUMENTS 3,982,718 9/1976 Folkenroth et al. ..... 187/269

OTHER PUBLICATIONS

"Eronomic Container Handling Equipment", Air Caster Corporation.

"Lift Table Arrangement Skirt Attachment AA&M", Hovair Systems, Inc.

*Primary Examiner*—Kenneth W. Noland

*Attorney, Agent, or Firm*—Walter W. Duft

[57] ABSTRACT

A safety skirt is disclosed for an industrial lift apparatus. The lift apparatus has a base, a movable element separate from the base, a connecting assembly joining the movable element to the base, and a power system for actuating the connecting assembly to change the position of the movable element relative to the base. The safety skirt includes a skirt bottom adapted for attachment to the lift apparatus base and a skirt top adapted for attachment to the lift apparatus movable element. A plurality of skirt sides extend between the skirt bottom and the skirt top. They are adapted to surround the lift apparatus connecting assembly in order to isolate industrial personnel from the area between the lift apparatus base and lift apparatus movable element. Each of the skirt sides is formed from a plurality of pleats, each having an upper flap and a lower flap made from a flexible nonwoven material. A plurality of hinges made from a flexible woven web material are attached, preferably by sewing, between the flaps forming each pleat, and between adjacent flaps of adjacent pleats. A plurality of corners are defined at the intersections of adjacent sides. The corners are formed by joining together adjacent pleats of the adjacent sides, preferably using fasteners.

26 Claims, 4 Drawing Sheets

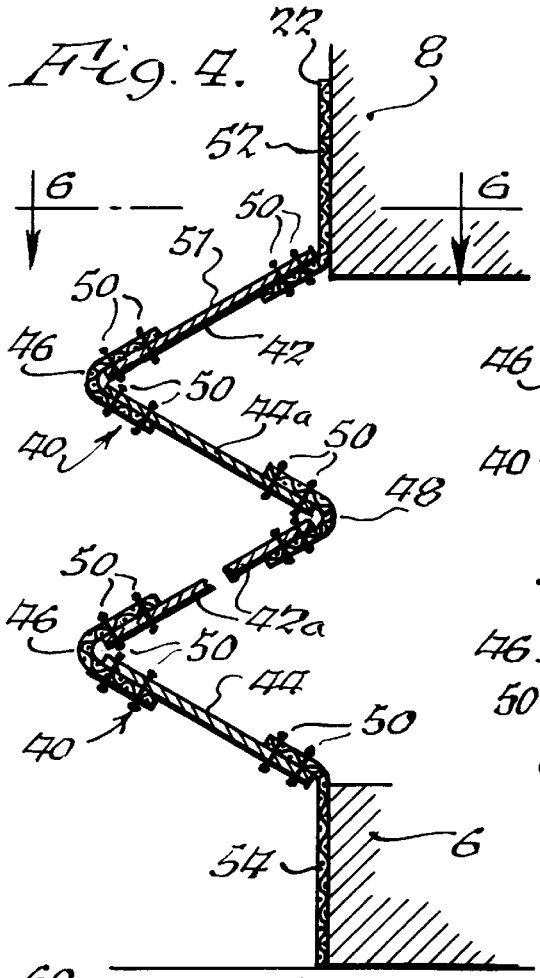
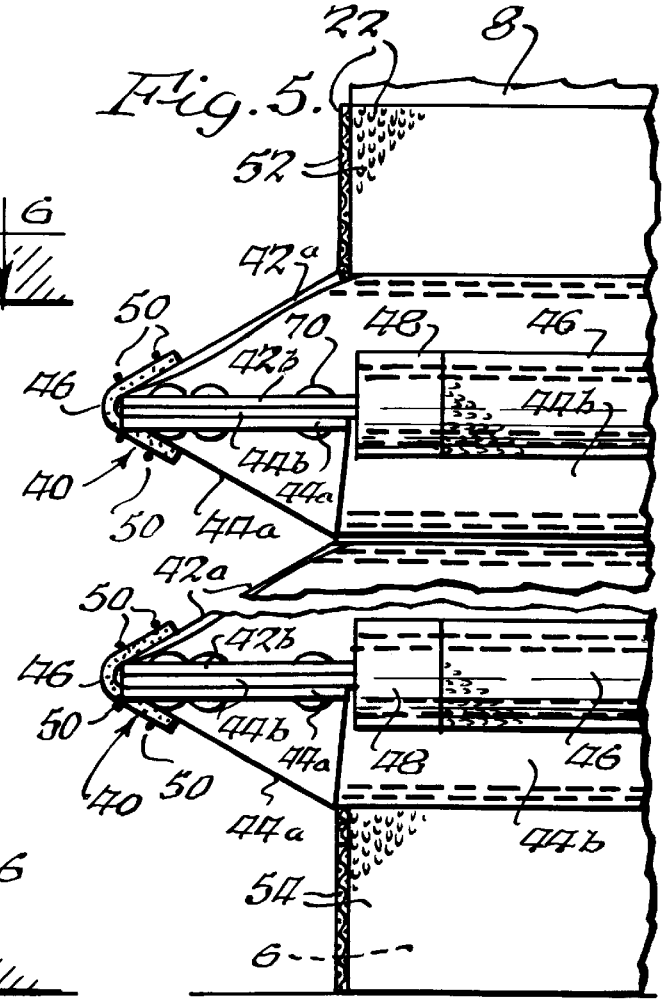
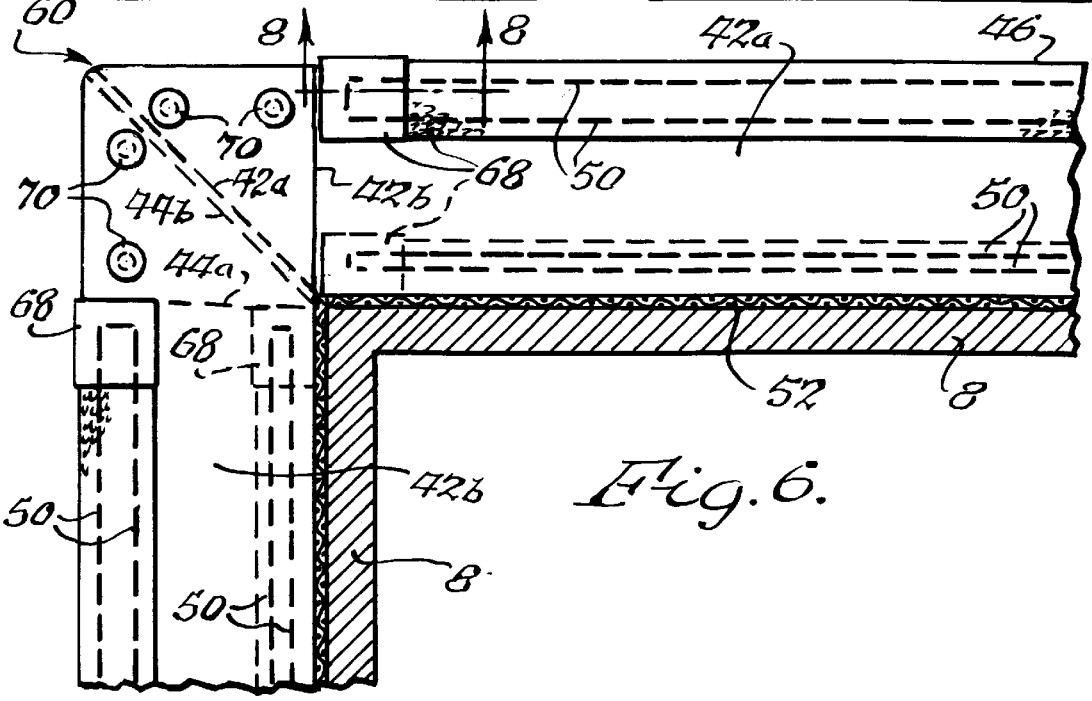
Fig. 6.

SAFETY SKIRT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is directed to an improved safety skirt for industrial lift apparatus used for assembly, equipment handling and the like.

2. Description of the Prior Art

Many industrial facilities use power driven lift apparatus, such as lift tables, for parts assembly, equipment handling and other purposes. Lift tables typically include an upper table top unit that provides a work surface. The table top is mounted to a lower base or footer unit that is typically the same size and shape as the table top. These components are connected via a linkage that is driven by a power actuating system mounted on the base. The table is equipped with a control system that allows manufacturing personnel to actuate the linkage in order to raise and lower the table top. In some table models, the table top can also be tilted and/or rotated.

Industrial safety laws mandate that a color-coded safety skirt be mounted to the aforementioned lift tables so as to extend from the periphery of the upper table top to the periphery of the lower base, in order to completely cover and enclose the movable linkage and drive actuating components. Safety skirts that have been employed to date are formed as accordion shaped flexible covers that are most often made from thin laminated vinyl. These prior art safety skirts are assembled using a combination of gluing, heat sealing and sewing techniques, such that a series of continuous horizontal pleats are formed around the periphery of the table. This construction provides a barrier to the interior linkage and drive actuating components, while allowing the skirt to flexibly follow the movement of the table.

A principal disadvantage of the prior art safety skirts is that they usually only last a few months before beginning to fail. A second disadvantage is that the lift table must usually be disassembled in order to mount a new safety skirt. A third disadvantage is that the prior art safety skirts cannot withstand impacts from sharp objects, such as forklifts. A fourth disadvantage is that the prior art safety skirts can rarely break a human fall or prevent body portions from entering the danger zone between the upper table top and the lower base unit. A fifth disadvantage is that, if any portion of the prior art safety skirts are damaged, the entire skirt must be replaced. A sixth disadvantage is that the prior art safety skirts are essentially designed using two-dimensional construction techniques but are expected to perform while moving in three dimensions. Accordingly, an improved safety skirt is needed that overcomes the foregoing deficiencies.

BRIEF SUMMARY OF THE INVENTION

It is an object of the present invention to provide a safety skirt that lasts years rather than months before having to be replaced.

It is a further object of the present invention to provide a safety skirt that can be mounted without disassembling the equipment on which it is mounted.

It is a further object of the present invention to provide a safety skirt that can withstand impacts from sharp objects.

It is a further object of the present invention to provide a safety skirt that prevents human body parts from entering the danger zone where moving parts and power actuating components are present.

It is a further object of the present invention to provide a safety skirt which need not be replaced in its entirety when a portion of the skirt is damaged.

It is a further object of the present invention to provided a safety skirt that is designed from a three-dimensional perspective so as to perform while moving in three dimensions.

In accordance with the present invention, a safety skirt of novel design is provided for use with an industrial lift apparatus. The lift apparatus includes a base, a movable element separate from the base, a connecting assembly joining the movable element to the base, and a power system for actuating the connecting assembly to change the position of the movable element relative to the base. The safety skirt includes a skirt bottom adapted for attachment to the lift apparatus base and a skirt top adapted for attachment to the lift apparatus movable element. A plurality of skirt sides extend between the skirt bottom and the skirt top. The sides are adapted to surround the lift apparatus connecting assembly in order to isolate industrial personnel from the area between the lift apparatus base and lift apparatus movable element. Each of the skirt sides is formed from a plurality of pleats, each having an upper flap and a lower flap made from a flexible nonwoven material. A plurality of hinges made from a flexible woven web material are attached, preferably by sewing, between the flaps forming each pleat, and between adjacent flaps of adjacent pleats. A plurality of corners are defined at the intersections of adjacent sides. The corners are formed by joining together adjacent pleats of the adjacent sides, preferably using fasteners.

BRIEF DESCRIPTION OF THE SEVERAL VIEWS OF THE DRAWING

The foregoing and other features and advantages of the invention will be apparent from the following more particular description of a preferred embodiment of the invention, as illustrated in the accompanying Drawing, in which:

FIG. 4 is a truncated cross-sectional view taken along line 4—4 in FIG. 3;

FIG. 5 is a truncated side view taken substantially in the direction of arrows 5—5 in FIG. 3;

FIG. 6 is a an enlarged partial plan view showing one corner of the safety skirt of FIG. 1;

DETAILED DESCRIPTION OF THE INVENTION

Figure 1:
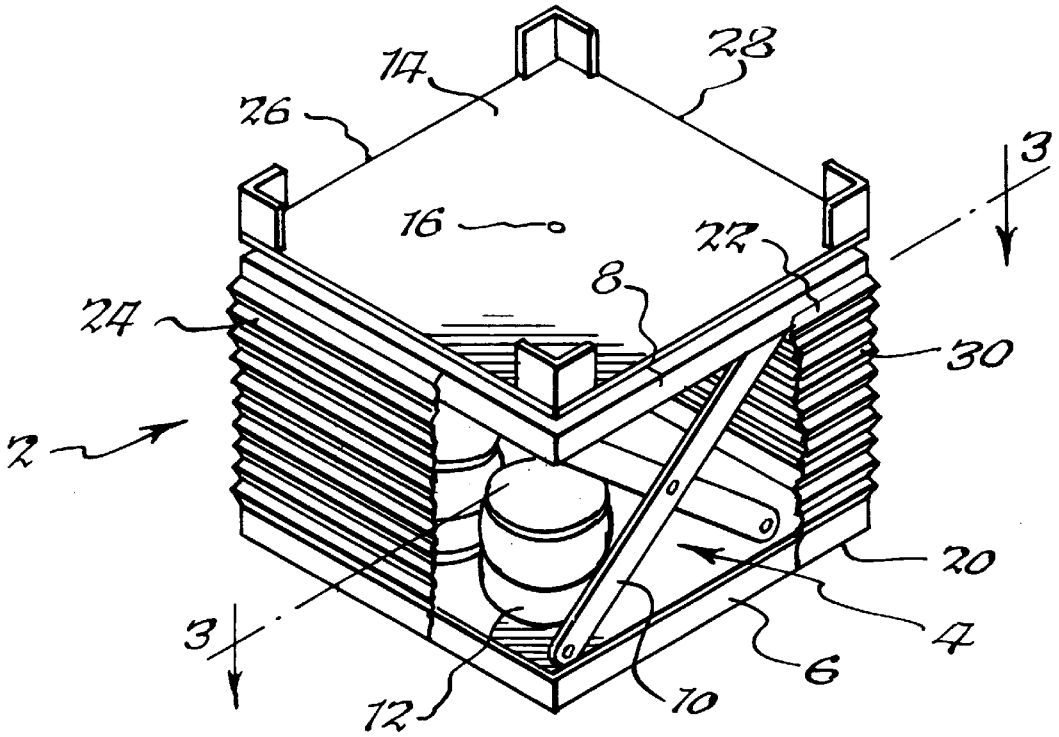
FIG. 1 is a perspective view, with a portion broken away for clarity, showing a safety skirt constructed in accordance with the present invention as it would be mounted on an industrial lift apparatus that is set in an extended position.
Figure 2:
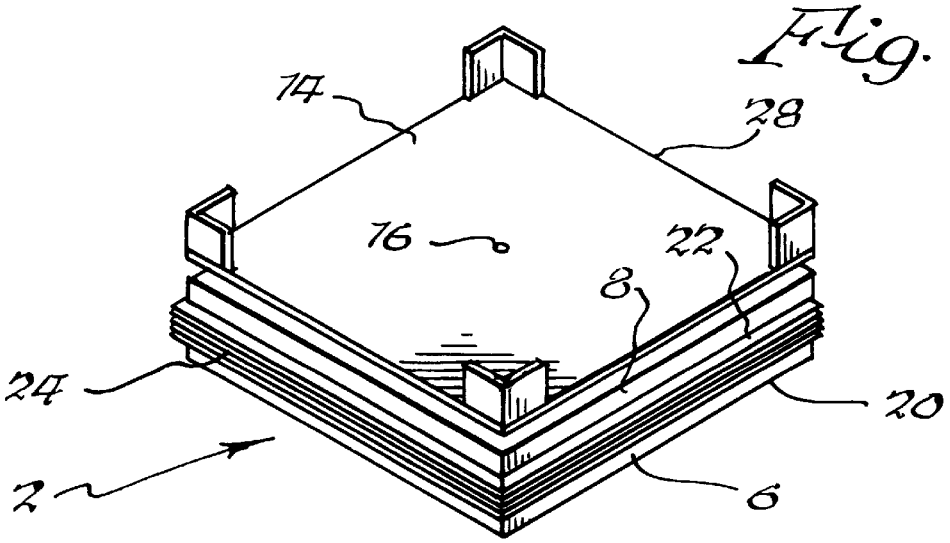
FIG. 2 is a perspective view showing the safety skirt and industrial lift apparatus of FIG. 1 with the lift apparatus set in a retracted position.

Turning now to the Drawing, wherein like reference numbers designate like elements in all of the several views, FIGS. 1 and 2 illustrate a safety skirt 2 constructed in accordance with a preferred aspect of the invention. The safety skirt 2 is shown as it would be mounted on an industrial lift apparatus 4, which could be a lift table or the like. A portion of the safety skirt is broken away in FIG. 1 to illustrate certain interior components of the lift apparatus 4.

The lift apparatus 4 has a base or footer 6 and a movable element 8 that is separate from the base. A connecting assembly 10, such as a scissor linkage, joins the movable element 8 to the base 6. A power system 12, such as a hydraulic actuator, is provided for actuating the connecting assembly 10 to change the position of the movable element 8 relative to the base 6. FIGS. 1 and 2 show that the movable element 8 can be raised and lowered relative to the base 6. The lift apparatus 4 could also be designed to allow tilting of the movable element 8 such that one side thereof is lower than another. A pivotable member, such as a table top 14, could also be mounted to the movable element 8 at a central pivotal connection 16, to provide a support surface that can be rotated about its pivotal axis in addition to the other adjustments previously described.

Figure 3:
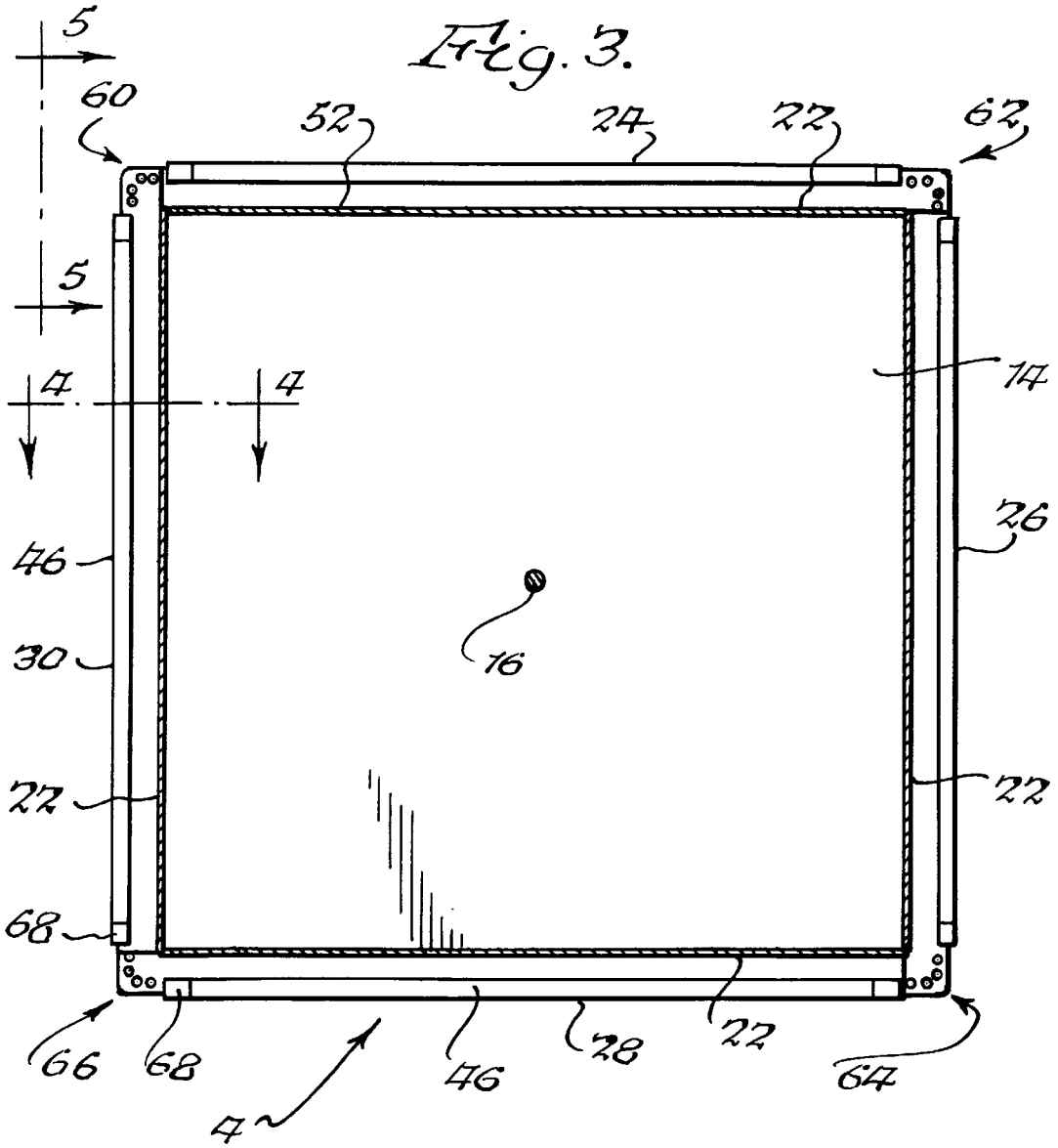
FIG. 3 is a longitudinal plan section view taken along line 3—3 in FIG. 1.

Still referring to FIGS. 1 and 2, and also considering FIG. 3, the safety skirt 2 includes an open skirt bottom 20 adapted for attachment to the lift apparatus base 6 and an open skirt top 22 adapted for attachment to the lift apparatus movable element 8. A plurality of sides 24, 26, 28 and 30, extend between the skirt bottom 20 and the skirt top 22. The sides 24, 26, 28 and 30 are adapted to surround the lift apparatus connecting assembly 10 and power system 12 in order to isolate industrial personnel from the area between the lift apparatus base 6 and the lift apparatus movable element 8. Although four sides are shown, it will be appreciated that the skirt could have any number of sides, depending on the configuration of the lift apparatus. For example, when viewed in plan, the skirt might define a triangle, a pentagon, a hexagon, or a circle, to name but a few.

Each of the sides 24, 26, 28 and 30 is formed from a plurality of pleats, as shown by reference numeral 40 in FIGS. 4 and 5. Each of the pleats 40 includes an upper flap 42 and a lower flap 44. Both flaps are preferably made from a flexible nonwoven material. For example, the flaps 40 and 42 could be made from vinyl. In that case, the vinyl should be of sufficient thickness, e.g., at least about 0.080 inches, so that the safety skirt 4 has good strength and durability. On the other hand, the vinyl must not be so thick as to limit flexibility.

Figure 7:
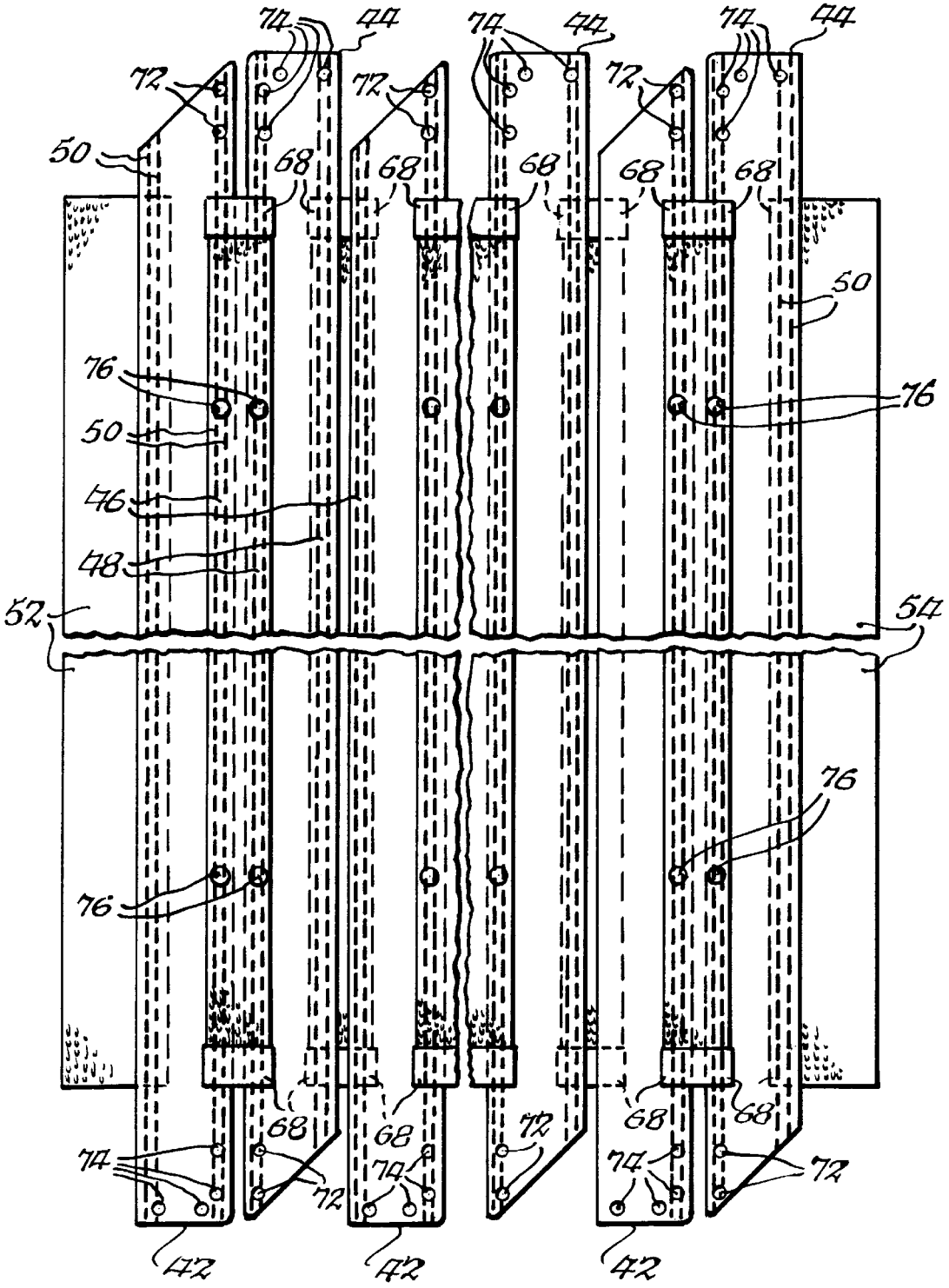
FIG. 7 is a truncated plan view showing one side of the safety skirt of FIG. 1 as it would appear lying flush against a flat surface as it is fabricated and before it is attached to other similarly constructed sides of the safety skirt.

The flaps 42 and 44 of each pleat are connected by hinges 46 that are preferably made from a flexible woven material, such as a cross-biased polypropylene or nylon binding. The hinges 46 are located on the exterior surfaces of the sides 24, 26, 28 and 30, and thus may be referred to as outer hinges. Each pleat 40 is interconnected to at least one adjacent pleat using additional hinges 48. The hinges 48 are preferably identical in construction to the hinges 46, but are located on the interior surfaces of the sides 24, 26, 28 and 30. The hinges 48 may thus be referred to as inner hinges. Each of the inner and outer hinges is preferably attached to the flaps 42 and 44 by sewing at least two seams 50 using high strength stitching, such as industrial grade nylon thread, for each connection. The seams 50 can be formed independently of each other as a pair of opened ended parallel stitches, as shown in FIG. 7. Alternatively, the seams 50 can also be formed as part of a closed double stitch pattern, as shown in FIG. 6.

Each pleat in a side of the safety skirt 4 may be thought of as comprising a pair of flaps 42 and 44 connected by an outer hinge 46, with each such pleat being connected to at least one other pleat by an inner hinge 48. The pleats are oriented with their vertices, formed by the outer hinges 46, facing outwardly, and their legs, formed by the flaps 42 and 44, facing inwardly. This geometry has been selected for convenience as an aid to understanding the preferred embodiment disclosed herein. It will be appreciated that each pleat could just as readily be thought of as including an upper flap 44 joined to a lower flap 42 via one of the inner hinges 48. In that case, the vertices of each pleat would face inwardly, while the legs of each pleat would face outwardly.

Current industrial safety laws mandate that physical hazards of the kind where safety skirts are typically employed must be designated by yellow and black color coding. Each of the pleats 40 are thus formed with these colors. In the preferred embodiment of the invention, the upper flaps 42 bear a yellow color designation while the outer hinges 46 bear a black designation. As shown in FIG. 4, a yellow designation can be applied to the upper flaps 42 using a layer of material 51, which could be tape, paint or any other suitable substance. Alternatively, the vinyl used to make the flaps 42 could be manufactured with a yellow color pigment therein. The black designation of the outer hinges 46 can be provided by using a black polypropylene binding. Additional color coding can be achieved by forming the lower flaps 44 from clear vinyl and the inner hinges 48 from a black polypropylene binding. Alternatively, the lower flaps 44 could be made from black vinyl, or covered with black tape, paint or any other suitable substance.

To complete the sides 24, 26, 28 and 30 of the safety skirt 4, a pair of upper and lower attachment webs 52 and 54 are secured to the uppermost and lowermost pleats 46, respectively, as shown in FIGS. 4 and 5. These webs are flexible in nature and preferably fabricated from woven polypropylene or the like. They are adapted for attaching the safety skirt 4 to the lift apparatus 2. Specifically, the upper attachment web 52 is adapted for engagement with the lift apparatus movable element 8, while the lower attachment web 54 is adapted for engagement with the lift apparatus base 6. The webs 52 and 54 are preferably secured to the flaps 42 and 44 of the uppermost and lowermost pleats, respectively, in the same manner as the hinges 46 and 48. Namely, a pair of seams 50 are sewn using high strength stitching, such as industrial strength nylon thread. The stitch pattern may either be open, as shown in FIG. 7, or closed, as shown in FIG. 6.

Figure 8:
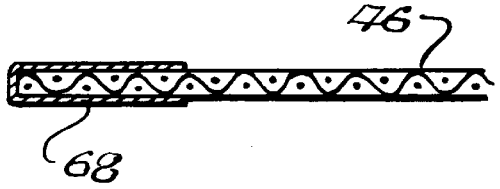
FIG. 8 is a partial cross-sectional view taken along line 8—8 in FIG. 6.

Turning now to FIG. 3 and 6, a plurality of corners 60, 62, 64 and 66 are formed at the intersections of adjacent ones of the sides 24, 26, 28 and 30. The corners 60, 62, 64 and 66 are formed by joining together individual adjacent pleats of the adjacent sides. To facilitate the formation of the corners, the hinges 46 and 48 are terminated short of the ends of the flaps forming each pleat. This can be seen with respect to the outer hinge 46 in FIG. 6. It has been found that terminating the hinges approximately 3 inches from the flap ends provides a sufficient amount of free flap material to form the corners. To prevent the hinges 46 and 48 from fraying or unraveling, the ends thereof are preferably covered at 68 with a protective material, as shown in detail in FIG. 8. The protective material could be tape or a coating applied in liquid form.

At each of the corners 60, 62, 64 and 66, the adjacent pleats of adjacent sides are connected by interleaving the ends of the opposing pleats in a stacked arrangement. This can be done in several ways. First, the flaps of one adjacent pleat could be completely interleaved with the flaps of the other adjacent pleat to form a four layer corner joint. Preferably, however, in order to reduce the size and complexity of the corner joints, a three layer corner joint is used. In the three layer corner joint, one flap of each adjacent pleat is mitered at its end, while the remaining flap of each adjacent pleat is nonmitered. The nonmitered flaps form the upper and lower exterior portions of the corner joint. The mitered flaps form the interior portion of the corner joint, which is sandwiched between the exterior portions of the corner joint. The ends of each mitered flap face each other to form a mitered joint, or flap junction, which is held in place by the flaps forming the exterior portions of the corner joint.

FIGS. 5 and 6 illustrate the foregoing arrangement at the corner 60 formed by the sides 24 and 30 of the safety skirt 4. For ease of understanding, the upper and lower flaps forming the pleats of the side 24 are labeled by the reference numerals 42*a* and 44*a*, respectively. The upper and lower flaps forming the pleats of the side 30 are labeled by the reference numerals 42*b* and 44*b*, respectively. As can be seen, the uppermost exterior layer of the corner joint 60 is provided by the upper flap 42*b* of the side 30. The lowermost exterior layer of the corner joint 60 is provided by the lower flap 44*a* of the side 24. The mitered interior layer of the corner joint 60 is provided by the upper flap 42*a* of the side 24 and the lower flap 44*b* of the side 30. Other arrangements would also be possible.

To secure the flaps forming the corner joints in place, a plurality of fasteners 70 are mounted so as to extend through all of the layers of each joint. The fasteners 70 are preferably rivets, but could also be screws, clips or other kinds of fastening devices. Although four fasteners 70 are illustrated in FIG. 6, a greater or lesser number of fasteners could be used depending on the size of the safety skirt and the application for which it is intended.

Turning now to FIG. 7, a side of the safety skirt 4 is shown as it would be laid out on a flat surface during its assembly, prior to being attached to other sides of the safety skirt. A side is made by first forming individual pleats and then combining the pleats to form a complete side. In the preferred fabrication process, a series of the flaps 42 and 44 are cut to length and prepared for assembly. The material used is preferably vinyl having a thickness of at least about 0.080 inches. In order to accommodate the formation of the corner joints, the flaps are cut so as to include an additional length at each end, e.g. about 3 inches, beyond the dimension of the lift apparatus that must be covered by the safety skirt side being constructed. For example, if the lift apparatus is a 48 inch by 48 inch lift table, the flaps should be cut to 54 inches. The width of each flap is selected based on the required height of each side, the number of desired pleats, and the amount of available space for the pleats when the safety skirt is in its collapsed position. For a safety skirt having a collapsed height of about 8 inches and an extended height of about 28 inches, it has been found that 8 pleats per side is sufficient. In that case, the width of each flap is cut to about 2¾ inches. If the material of the upper flaps is not yet color coded, a color is added by applying tape or paint or the like.

In a next step, lengths of the material used for the hinges 46 and 48 are cut and the ends are treated, using tape or the like, to form the protective covering 68. As described above, the hinges 46 and 48 are preferably cut shorter than the flaps 42 and 44 so as to provide free flap ends for forming the corner joints. Cutting the hinges about six inches shorter than the flaps, so as to provide three inches of free flap area at each end, has been found to be sufficient for typical safety skirt applications. The width of the hinges must be sufficient to allow room for their attachment to the flaps and to provide sufficient clearance between adjacent flaps to prevent binding when the pleats are opened and closed. It has been found that 2 inches is a sufficient width for the hinges.

The attachment webs 52 and 54 are also cut to length. It has been found that cutting the attachment webs to a length of about 6 inches less than the length of the flaps 42 and 44 is sufficient. Cutting the attachment webs 52 and 54 to a width of about 3 inches provides sufficient area for attaching the safety skirt 4 to the lift apparatus 2. As described above, once the attachment webs are cut, their ends are preferably heat sealed to preserve their integrity.

Once the flap, hinge and attachment webs are prepared, the next step in the assembly process is to sew the hinges to individual ones of the flaps. It has been found that sewing the hinges to the lower flaps 44 works well, but the upper flaps 42 could also serve as the starting point. The hinges are sewn to the flaps one at a time. The hinge to be sewn is centered over the flap and positioned so that the edges of the flap and the hinge overlap a distance sufficient to accommodate two rows of stitching. It has been found that an overlap a distance of about ⅞ inches is sufficient. Once the first hinge is sewn to one edge of the flap, the flap is turned over and the second hinge is sewn to the other edge of the flap. As described above, double rows of stitching are preferred.

The next step in the assembly process is to sew the remaining flaps to the free ends of the hinges to complete the pleats. Thus, if the hinges are first sewn to the lower flaps 44, the upper flaps are now sewn to the hinges, and visa versa. To perform this step, the flap to be attached should be spaced from the previously sewn flap to provide a sufficient amount of overlap of the previously sewn hinge to the flap that will be attached. For a 2 inch wide hinge that will overlie the flaps by ⅞ inches, it has been found that ¼" inches is a sufficient separation distance for the flaps. It should be noted that if a color coding layer 51 is applied to the upper flap 42, it should be on the same side on which the outer hinge 46 is mounted.

Once the second set of flaps is attached to the initial set of flaps and hinges, a series of pleats will have been formed. With the exception of the top and bottom pleats, each pleat will consist of two flaps, a fully connected hinge extending between the flaps, and a partially connected free hinge extending from one edge of one of the flaps. One of the flaps of each pleat will have a free edge with no hinge attached to it. The top and bottom pleats will consist of two flaps, a fully connected hinge, and an attachment web extending from one edge of one of the flaps. To complete each side, the pleats are arranged in parallel rows with the upper and lower flaps 42 and 44 laid out in alternating fashion. The pleats are interconnected by attaching the free hinge of each pleat to the free flap edge of an adjacent pleat. The attachment webs 52 and 54 are sewn to two of the pleats, either prior to or after connecting the pleats to each other in order to form a side.

Once the pleats are interconnected, hole patterns 72 and 74 are punched or drilled near the ends of the flaps 42 and 44 to accommodate the fasteners 70 used to secure the corners 60, 62, 64 and 66. Additional holes 76 can be punched or drilled periodically along the common adjacent edges of the flaps 42 and 44, so as to extend through both the flaps and the hinges 46. The holes 76 are positioned so that when the flaps 42 and 44 are folded over on each other to form the pleats 40, additional fasteners 70 can be secured through the holes to help secure the hinges. The fasteners 70 may be provided at periodic intervals, e.g., one foot, along the length of the flaps 42 and 44.

To complete the sides 24, 26, 28 and 30, one end of each of the upper flaps 42 is mitered, while the opposite end of each of the lower flaps 44 is mitered. Alternatively, the flap ends could be mitered after the pleats are connected together to form a side. Thereafter, the all sharp edges are rounded and the sides are ready for assembly into a completed safety skirt.

Each side 24, 26, 28 and 30 is identical to the side illustrated in FIG. 7. The sides are made separately and then joined together at the corners 60, 62, 64 and 66 to form the safety skirt 4. As previously described, the corners are formed by individually joining together adjacent pleats of adjacent sides of the safety skirt. The completed safety skirt 4 should snugly fit the lift apparatus 2 and peripherally engage the lift apparatus base 6 and the lift apparatus movable element 8. Advantageously, in order to avoid having to disassemble the lift apparatus 2 in order to mount the safety skirt, the final assembly of the safety skirt can be performed with the safety skirt mounted on the lift apparatus. This can be achieved if, prior to completing the formation of the final corner, the skirt sides are arranged at or near their final positions enveloping the area between the lift apparatus base 6 and the lift apparatus movable element 8. With the sides so positioned, the final corner can be formed so that the walls of the safety skirt is completely connected. Should a side of the safety skirt become damaged during use, it is a relatively easy matter to remove the fasteners 70 and replace the damaged side with a new one.

Accordingly, a safety skirt for an industrial lift apparatus has been described. While various embodiments have been disclosed, it should be apparent that many variations and alternative embodiments would be apparent to those skilled in the art in view of the teachings herein. It is understood, therefore, that the invention is not to be in any way limited except in accordance with the spirit of the appended claims and their equivalents.

What is claimed is:

1. A safety skirt for an industrial lift apparatus having a base, a movable element separate from said base, a connecting assembly joining said movable element to said base, and a power system for actuating said connecting assembly to change the position of said movable element relative to said base, said safety skirt comprising:

a skirt bottom adapted for attachment to the lift apparatus base;

a skirt top adapted for attachment to the lift apparatus movable element;

a plurality of sides extending between said skirt bottom and said skirt top and adapted to surround the lift apparatus connecting assembly in order to isolate industrial personnel from the area between said lift apparatus base and said lift apparatus movable element;

each of said sides being formed from a plurality of pleats;

each of said pleats having an upper flap and a lower flap made from a flexible nonwoven material;

a plurality of hinges attached between the flaps forming each pleat, and between adjacent flaps of adjacent pleats, said hinges being made from a flexible woven web material; and a plurality of corners defined at the intersections of adjacent ones of said sides, said corners being formed by joining together adjacent pleats of said adjacent ones of said sides.

2. A safety skirt in accordance with claim 1 wherein said flaps are made of a durable polymeric sheet material and said hinges are made of a double-stitched woven material.

3. A safety skirt in accordance with claim 2 wherein said flaps are made of vinyl having a thickness of at least about 0.080 inches.

4. A safety skirt in accordance with claim 2 wherein said hinges are made of a woven polypropylene material.

5. A safety skirt in accordance with claim 1 wherein said hinges are sewn to said flaps.

6. A safety skirt in accordance with claim 1 wherein said adjacent pleats of said adjacent ones of said sides are connected by fasteners.

7. A safety skirt in accordance with claim 1 wherein said adjacent pleats of said adjacent ones of said sides are connected by interleaving the ends of said adjacent pleats in a stacked arrangement and riveting said adjacent pleats together to form interleaved corners of said safety skirt.

8. A safety skirt in accordance with claim 7 wherein said adjacent pleats of said adjacent ones of said sides have flaps with mitered ends that adjoin each other at said interleaved corners to form a mitered flap junction, and wherein a flap of one of said adjacent pleats overlies said mitered flap junction while a flap of the other one of said adjacent pleats underlies said mitered flap junction.

9. A safety skirt in accordance with claim 1 wherein the pleats at said skirt bottom and at said skirt top are connected to flexible woven webs that are respectively adapted for engagement with said lift apparatus base and said lift apparatus movable element.

10. A safety skirt in accordance with claim 9 wherein said flexible woven webs are stitched to said pleats using a closed stitch pattern.

11. In combination with an industrial lift apparatus having a base, a movable element separate from said base, a connecting assembly joining said movable element to said base, and a power system for actuating said connecting assembly to change the position of said movable element relative to said base, a safety skirt comprising:

a skirt bottom attached to the lift apparatus base;

a skirt top attached to the lift apparatus movable element;

a plurality of sides extending between said skirt bottom and said skirt top and providing a periphery around the lift apparatus connecting assembly in order to isolate industrial personnel from the area between said lift apparatus base and said lift apparatus movable element;

each of said sides being formed from a plurality of pleats;

each of said pleats having an upper flap and a lower flap made from a flexible nonwoven material;

a plurality of hinges attached between the flaps forming each pleat, and between adjacent flaps of adjacent ones of said pleats, said hinges being made from a flexible woven web material and being sewn to said flaps;

a plurality of corners defined at the intersections of adjacent ones of said sides, said corners being formed by joining together adjacent pleats of said adjacent ones of said sides; and a plurality of fasteners located at said corners and extending through the flaps of said adjacent pleats of said adjacent ones of said sides.

12. A combination in accordance with claim 11 wherein said flaps are made of a durable polymeric sheet material and said hinges are made of a double-stitched woven material.

13. A combination in accordance with claim 12 wherein said flaps are made of vinyl having a thickness of at least 0.080 inches.

14. A combination in accordance with claim 12 wherein said hinges are made of a woven polypropylene material.

15. A combination in accordance with claim 11 wherein said hinges are sewn to said flaps using a double stitch pattern.

16. A combination in accordance with claim 11 wherein said fasteners are metallic.

17. A combination in accordance with claim 11 wherein said corners are formed by interleaving the ends of said adjacent pleats of said adjacent ones of said sides in a stacked arrangement and riveting said adjacent pleats together to form interleaved corners of said safety skirt.

18. A combination in accordance with claim 17 wherein said adjacent pleats of said adjacent ones of said sides have flaps with mitered ends that adjoin each other at said interleaved corners to form a mitered flap junction, and wherein the remaining flap of one of said adjacent pleats overlies said mitered flap junction while the remaining flap of the other one of said adjacent pleats underlies said mitered flap junction.

19. A combination in accordance with claim 11 wherein the pleats at said skirt bottom and at said skirt top are connected to flexible woven webs that are respectively engaged with said lift apparatus base and said lift apparatus movable element.

20. A combination in accordance with claim 19 wherein said flexible woven webs are stitched to said pleats using a closed stitch pattern.

21. A method for fabricating a safety skirt for an industrial lift apparatus having a base, a movable element separate from said base, a connecting assembly joining said movable element to said base, and a power system for actuating said connecting assembly to change the position of said movable element relative to said base, said safety skirt fabrication method comprising the following steps:

fabricating a plurality of pleats, each pleat being formed by interconnecting a first flap made from a flexible sheet material to a second flap made from a flexible sheet material using an interconnecting hinge made from a flexible web material;

interconnecting plural ones of said pleats to form a plurality of skirt side members, said pleats being interconnected using interconnecting hinges made from a flexible web material;

interconnecting said skirt side members to form a complete skirt adapted to provide a periphery around the area between the lift apparatus base and the lift apparatus movable element, said interconnecting step being performed by joining together adjacent pleats of selected ones of said skirt side members arranged in adjacent relationship; and prior to completing said interconnecting step, arranging said skirt side members so as to envelope said area between said lift apparatus base and said lift apparatus movable element, whereby said lift apparatus need not be dissembled in order to mount said skirt thereon.

22. A safety skirt for an industrial lift apparatus having a base, a movable element separate from said base, a connecting assembly joining said movable element to said base, and a power system for actuating said connecting assembly to change the position of said movable element relative to said base, said safety skirt comprising:

a skirt bottom adapted for attachment to the lift apparatus base;

a skirt top adapted for attachment to the lift apparatus movable element;

a plurality of sides extending between said skirt bottom and said skirt top and adapted to surround the lift apparatus connecting assembly in order to isolate industrial personnel from the area between said lift apparatus base and said lift apparatus movable element;

each of said sides being formed from a plurality of pleats;

each of pleats having an upper flap and a lower flap made from a flexible material; and a plurality of corners defined at the intersections of adjacent ones of said sides, said corners being formed by joining together adjacent pleats of said adjacent ones of said sides such that the upper and lower flaps of the pleats of said adjacent sides are interleaved in a stacked arrangement.

23. The safety skirt of claim 22 wherein the upper and lower flaps of the pleats of a first one of said adjacent sides are respectively interleaved with the upper and lower flaps of the pleats of a second one of said adjacent sides, such that said corners are formed by alternating ones of the flaps of said adjacent sides.

24. The safety skirt of claim 22 wherein said corners are formed as three-layer corner joints having a non-mitered upper layer formed by the upper pleat of a first one of said adjacent sides, a non-mitered bottom layer formed by the lower pleat of a second one of said adjacent sides, and an intermediate mitered layer formed by mitered end portions of the remaining flaps of said adjacent sides.

25. The safety skirt of claim 22 wherein said corners are formed as four layer corner joints having an upper layer formed by the upper pleat of a first one of said adjacent sides, a bottom layer formed by the lower pleat of said first one of said adjacent sides or by the lower pleat of a second one of said adjacent sides, and intermediate layers formed by the remaining flaps of said adjacent sides.

26. A safety skirt for an industrial lift apparatus having a base, a movable element separate from said base, a connecting assembly joining said moveable element to said base, and a power system for actuating said connecting assembly to change the position of said movable element relative to said base, said safety skirt comprising:

a skirt bottom adapted for attachment to the lift apparatus base;

a skirt top adapted for attachment to the lift apparatus movable element;

a plurality of sides extending between said skirt bottom and said skirt top and adapted to surround the lift apparatus connecting assembly in order to isolate industrial personnel from the area between said lift apparatus base and said lift apparatus movable element;

each of said sides being formed from a plurality of pleats;

each of said pleats having an upper flap and a lower flap made from a flexible material; and means for forming a plurality of interleaved corners at the intersections of adjacent ones of said sides.

* * * * *